US010656591B2

(12) United States Patent
Saeki

(10) Patent No.: US 10,656,591 B2
(45) Date of Patent: May 19, 2020

(54) IMAGE FORMING APPARATUS

(71) Applicant: BROTHER KOGYO KABUSHIKI KAISHA, Nagoya-shi, Aichi-ken (JP)

(72) Inventor: Masahito Saeki, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/353,101

(22) Filed: Mar. 14, 2019

(65) Prior Publication Data

US 2019/0302676 A1 Oct. 3, 2019

(30) Foreign Application Priority Data

Mar. 29, 2018 (JP) ..... 2018-063872

(51) Int. Cl.
*G03G 21/16* (2006.01)
*G03G 21/18* (2006.01)

(52) U.S. Cl.
CPC ..... *G03G 21/1633* (2013.01); *G03G 21/1842* (2013.01)

(58) Field of Classification Search
CPC ..... G03G 21/1633; G03G 21/1842
See application file for complete search history.

(56) References Cited

U.S. PATENT DOCUMENTS

| | | | |
|---|---|---|---|
| 2006/0029418 | A1 | 2/2006 | Ishii et al. |
| 2006/0029419 | A1 | 2/2006 | Shiraki |
| 2006/0029420 | A1 | 2/2006 | Ishii et al. |
| 2006/0029421 | A1 | 2/2006 | Ishii et al. |
| 2006/0029422 | A1 | 2/2006 | Shiraki |
| 2006/0029423 | A1 | 2/2006 | Shiraki |
| 2006/0133850 | A1 | 6/2006 | Nishimura |
| 2016/0041519 | A1 | 2/2016 | Sato |

FOREIGN PATENT DOCUMENTS

| | | | |
|---|---|---|---|
| JP | 2006-106020 | A | 4/2006 |
| JP | 2006-184502 | A | 7/2006 |
| JP | 2016-038512 | A | 3/2016 |

*Primary Examiner* — David M. Gray
*Assistant Examiner* — Andrew V Do
(74) *Attorney, Agent, or Firm* — Merchant & Gould P.C.

(57) ABSTRACT

An image forming apparatus includes: a housing having an opening; a drum cartridge mountable and demountable through the opening; a toner cartridge mountable and demountable to and from the drum cartridge; a first cover; a second cover, wherein, when the first cover is at the opened position and the second cover is at the closed position, the toner cartridge is allowed to be mounted and demounted to and from the drum cartridge through a part of the opening while the drum cartridge is remained to be mounted to the housing, and wherein, when the first cover is at the opened position and the second cover is at the closed position, a part of the second cover contacts with the drum cartridge and prevents the drum cartridge to be mounted and demounted to and from the housing through a part of the opening.

14 Claims, 11 Drawing Sheets

IMAGE FORMING APPARATUS

CROSS-REFERENCE TO RELATED APPLICATION

This application claims priorities from Japanese Patent Application No. 2018-063872 filed on Mar. 29, 2018, the entire subject matters of which is incorporated herein by reference.

TECHNICAL FIELD

The present disclosure relates to an image forming apparatus including a drum cartridge.

BACKGROUND

In the related art, an image forming apparatus having a drum cartridge that is detachably mounted has been known in which a toner cartridge can be further detachably mounted to the drum cartridge and the drum cartridge and the toner cartridge can be individually replaced. When replacing only the toner cartridge, the drum cartridge is demounted from the image forming apparatus and the toner cartridge is then demounted from the drum cartridge.

However, in the related art, even when a user intends to replace only the toner cartridge, the user should demount the entire drum cartridge having the toner cartridge mounted thereto from the image forming apparatus.

SUMMARY

The present disclosure has been made in view of the above circumstances, and one of objects of the present disclosure is to provide an image forming apparatus from which a toner cartridge and a drum cartridge can be easily replaced.

According to an illustrative embodiment of the present disclosure, there is provided an image forming apparatus including: a housing having an opening; a drum cartridge mountable and demountable through the opening, the drum cartridge having a photosensitive drum rotatable about a first axis extending in an axial direction; a toner cartridge mountable and demountable to and from the drum cartridge, the toner cartridge being capable of accommodating toner therein; a first cover rotatable about a second axis extending in the axial direction and rotatable between a closed position at which a part of the opening is covered and an opened position at which a part of the opening is opened; and a second cover in alignment with the first cover in the axis direction, the second cover rotatable about the second axis and being rotatable between a closed position at which a part of the remaining of the opening is covered and an opened position at which a part of the remaining of the opening is opened. In a state in which the first cover is located at the opened position and the second cover is located at the opened position, the drum cartridge and the toner cartridge are allowed to be mounted and demounted through the opening In a state in which the first cover is located at the opened position and the second cover is located at the closed position, the toner cartridge is allowed to be mounted and demounted to and from the drum cartridge through a part of the opening while the drum cartridge is remained to be mounted to the housing. In a state in which the first cover is located at the opened position and the second cover is located at the closed position, a part of the second cover contacts with the drum cartridge and prevents the drum cartridge to be mounted and demounted to and from the housing through a part of the opening.

DETAILED DESCRIPTION

Hereinafter, a first illustrative embodiments of the present disclosure will be described in detail with reference to the drawings.

Figure 1:
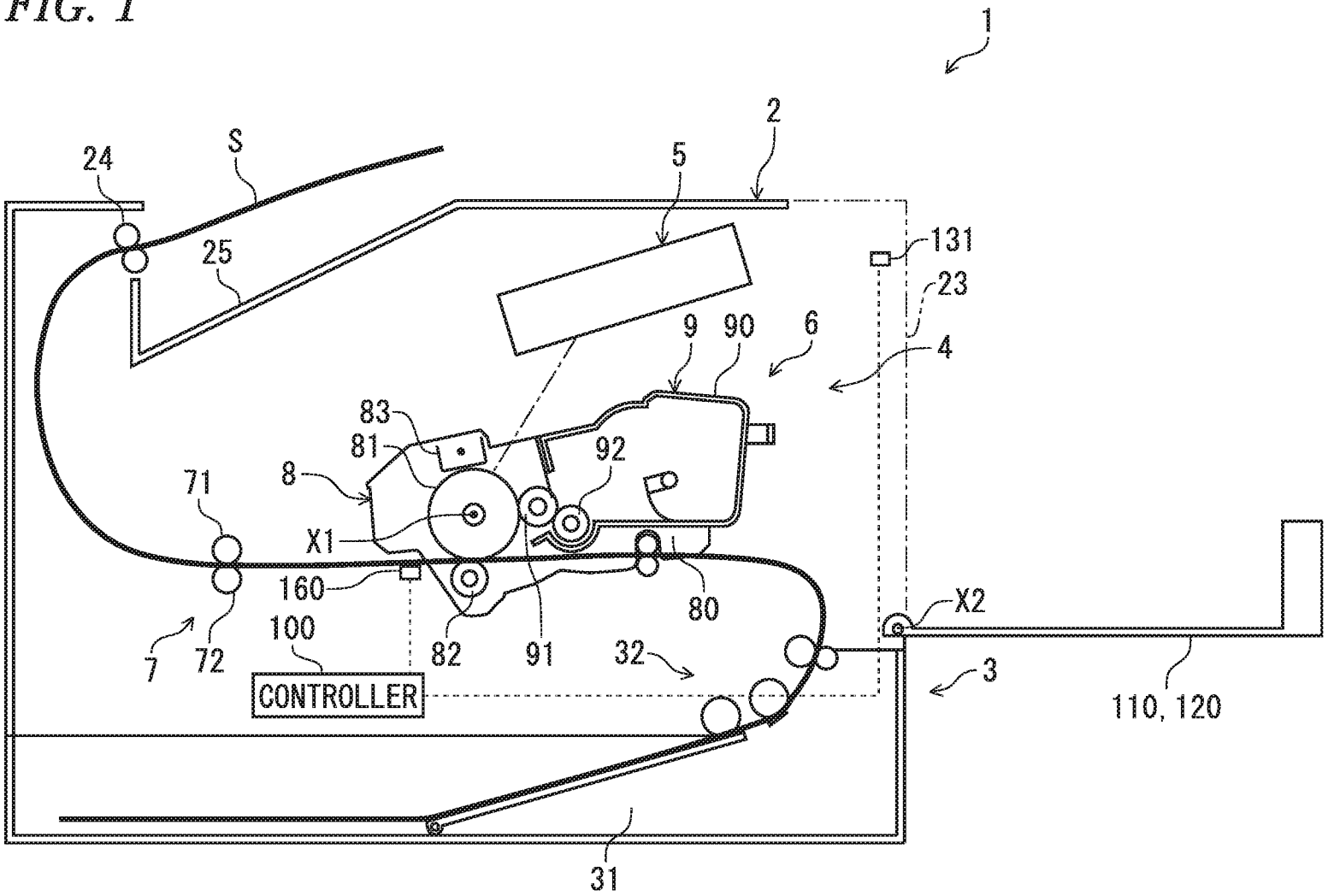
FIG. 1 illustrates a schematic configuration of an image forming apparatus according to a first illustrative embodiment of the present disclosure;.

As shown in FIG. 1, an image forming apparatus 1, which is a monochrome laser printer, mainly includes a housing 2, a feeder unit 3, an image forming unit 4 and a controller 100. The feeder unit 3 is configured to feed a recording sheet S into the housing 2. The image forming unit 4 is configured to form an image on the recording sheet S.

The housing 2 has an opening 23, a first cover 110, and a second cover 120. The opening 23 is arranged at a front surface of the housing 2.

The feeder unit 3 includes a feeder tray 31 and a feeder mechanism 32. The feeder tray 31 is detachably mounted to a lower part of the housing 2. The feeder mechanism 32 is configured to feed the recording sheet S in the feeder tray 31 toward the image forming unit 4.

The image forming unit 4 includes a scanner unit 5, a process cartridge 6, and a fixing device 7.

The scanner unit 5 is provided at an upper part in the housing 2 and includes a laser light-emitting unit, a polygon mirror, a lens, a reflector and the like, which are not shown. With the scanner unit 5, a laser beam is scanned at high speed on a surface of a photosensitive drum 81, which will be described later.

The process cartridge 6 is mounted between the feeder unit 3 and the scanner unit 5. The process cartridge 6 includes a drum cartridge 8 and a toner cartridge 9. The toner cartridge 9 can be mounted and demounted to and from the drum cartridge 8. The drum cartridge 8 can be mounted and demounted with the toner cartridge 9 being mounted thereto with respect to the image forming apparatus 1 from the opening 23, as the process cartridge 6.

Figure 2:
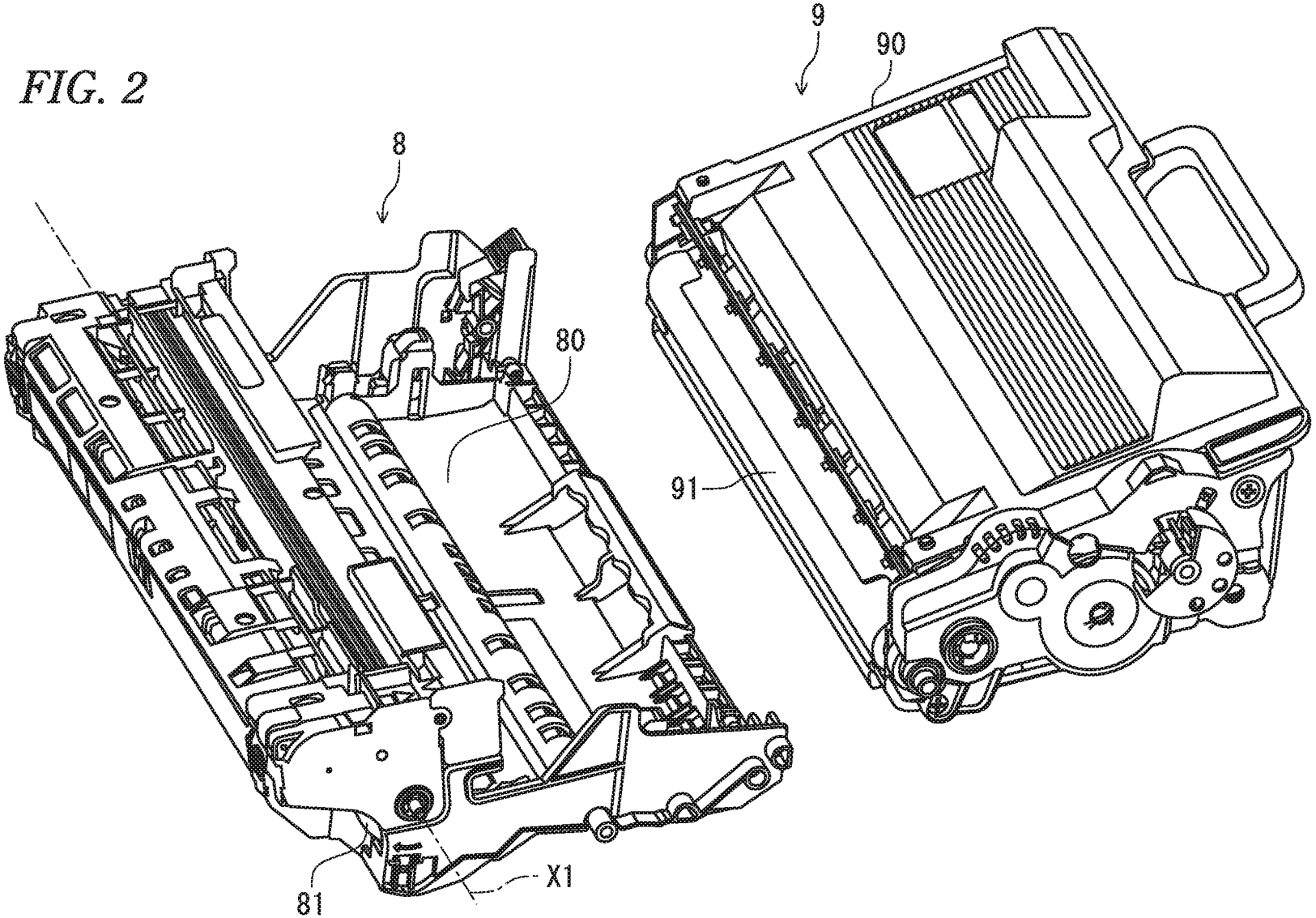
FIG. 2 is a perspective view illustrating a drum cartridge and a toner cartridge.

The drum cartridge 8 mainly includes a drum frame 80 to which the toner cartridge 9 can be mounted, a photosensitive drum 81, a transfer roller 82 and a charger 83. The photosensitive drum 81 can rotate about a first axis X1 extending in an axial direction (refer to FIG. 2).

The toner cartridge 9 mainly includes a case 90 capable of accommodating therein toner, a developing roller 91 and a supply roller 92. The developing roller 91 is configured to supply the toner to the photosensitive drum 81. The supply roller 92 is configured to supply the toner in the case 90 to the developing roller 91.

In the process cartridge 6, a surface of the photosensitive drum 81 being rotating is uniformly charged by the charger 83 and is then exposed by the high-speed scanning of the laser beam emitted from the scanner unit 5. Thereby, a potential of the exposed part is lowered, so that an electrostatic latent image based on image data is formed on the surface of the photosensitive drum 81.

Then, the developing roller 91 rotates, so that the toner in the toner cartridge 9 is supplied to the electrostatic latent image on the photosensitive drum 81 and a toner image is thus formed on the surface of the photosensitive drum 81. Thereafter, the recording sheet S is conveyed between the photosensitive drum 81 and the transfer roller 82, so that the toner image carried on the surface of the photosensitive drum 81 is transferred to the recording sheet S.

The fixing device 7 includes a heating roller 71 and a pressing roller 72. The pressing roller 72 is arranged to face the heating roller 71. In the fixing device 7, the toner transferred to the recording sheet S is heat-fixed while the recording sheet S passes between the heating roller 71 and the pressing roller 72.

The recording sheet S heat-fixed by the fixing device 7 is conveyed to sheet discharge rollers 24 arranged downstream of the fixing device 7 and is then delivered from the sheet discharge rollers 24 onto a sheet discharge tray 25.

Figure 3:
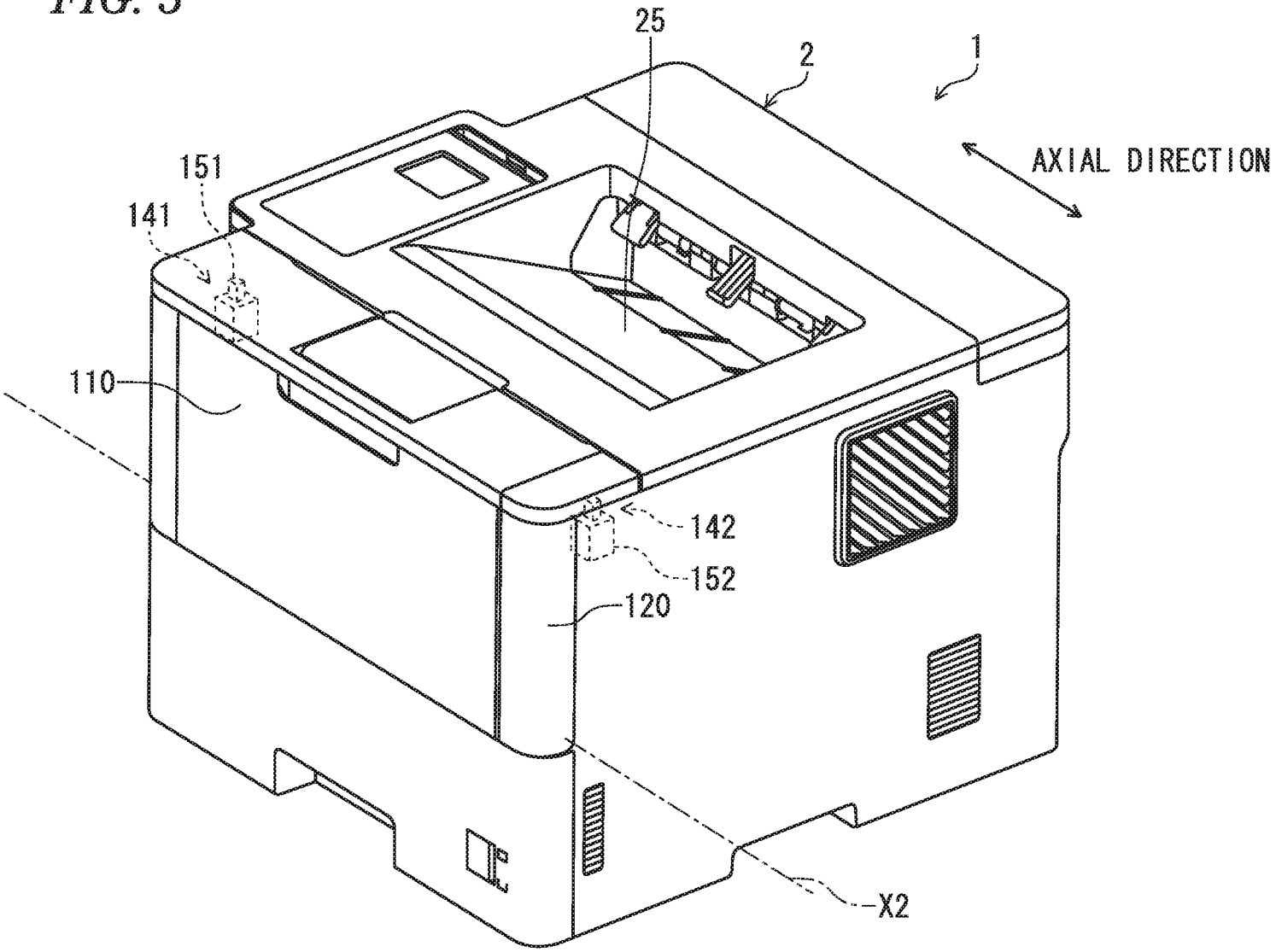
FIG. 3 is a perspective view illustrating the image forming apparatus.

As shown in FIG. 3, the first cover 110 and the second cover 120 are arranged to cover the opening 23. The first cover 110 and the second cover 120 are front covers.

Figure 4B:
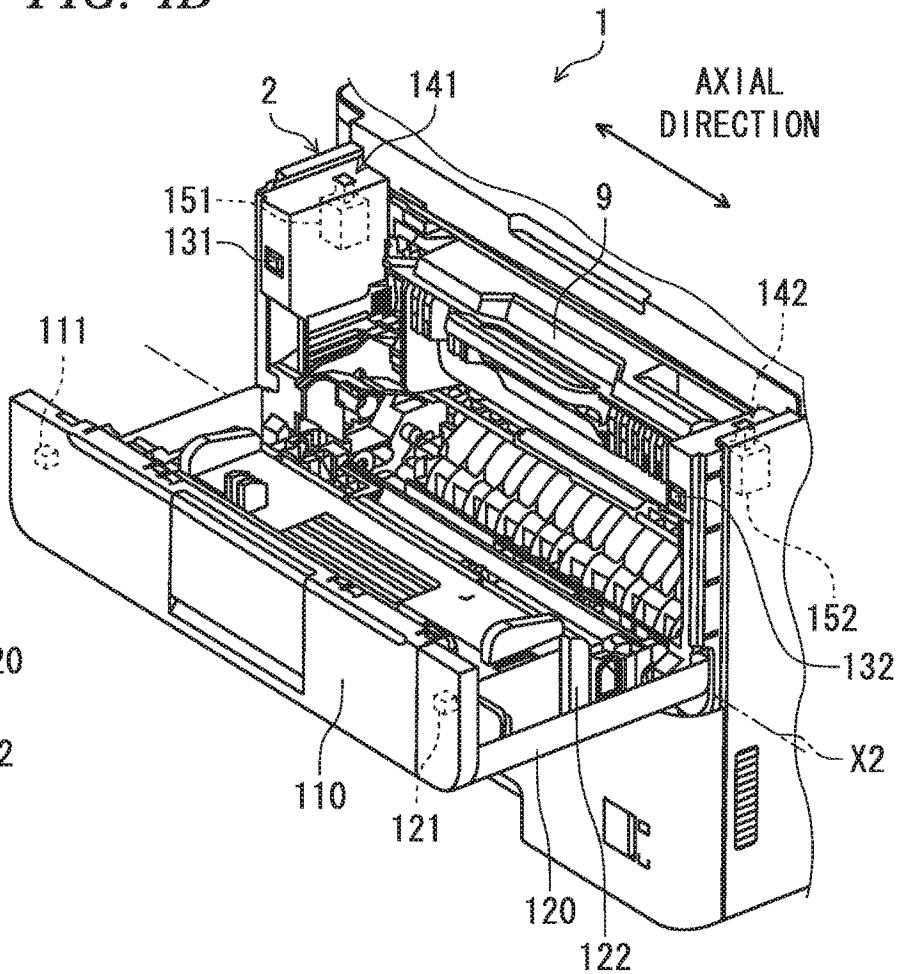
FIG. 4B illustrates a state where the first cover and a second cover are opened.
Figure 4A:
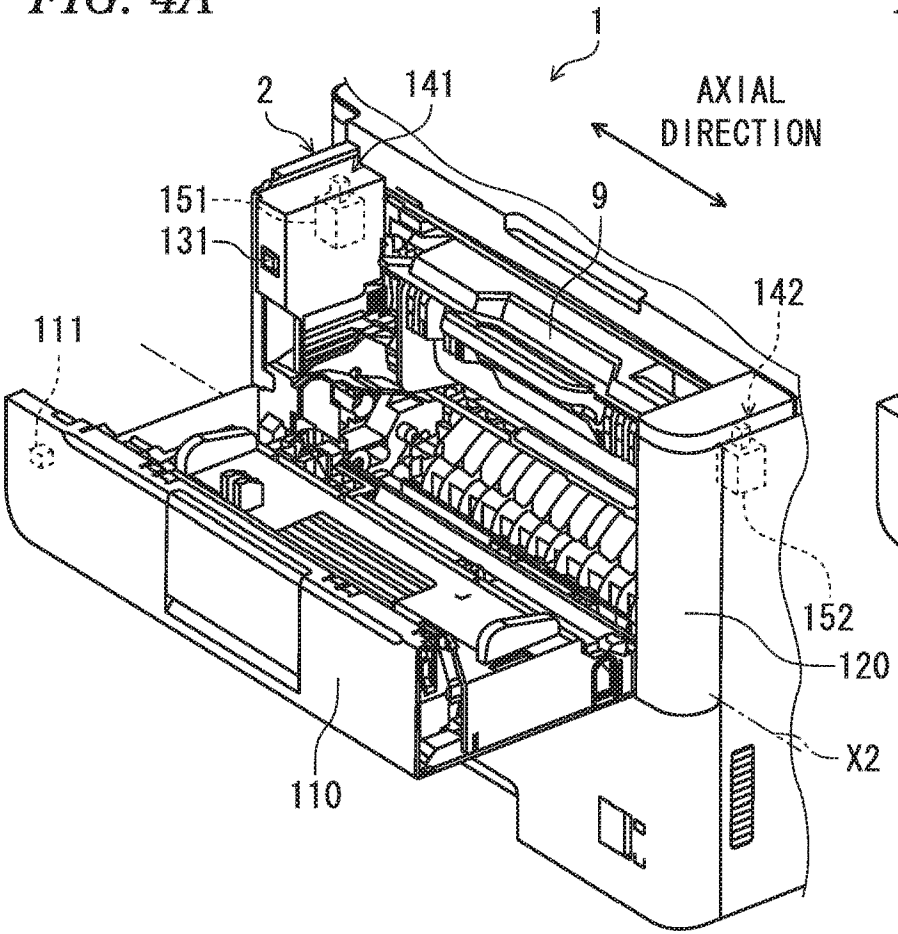
FIG. 4A illustrates a state where a first cover is opened from a state of FIG. 3.

As shown in FIGS. 3 and 4A, the first cover 110 can rotate about a second axis X2 extending in the axial direction. The first cover 110 is rotatable between a closed position (a position shown in FIG. 3) at which a part of the opening 23 is covered and an opened position (a position shown in FIG. 4A) at which a part of the opening 23 is opened.

The first cover 110 has a first concave portion 111. The first concave portion 111 engages with a first solenoid 151 (which will be described later), so that the first cover 110 is locked to the housing 2.

The image forming apparatus 1 further includes a first cover sensor 131 and a first lock mechanism 141.

The first cover sensor 131 is provided at the front surface of the housing 2 facing the first cover 110 of the housing 2. The first cover sensor 131 is configured to detect opening and closing of the first cover 110. The first cover sensor 131 is a push switch, for example. Specifically, when the first cover 110 is located at the closed position, the first cover 110 is in contact with the first cover sensor 131, and when the first cover 110 is located at the opened position, the first cover 110 is not in contact with the first cover sensor 131, so that the opening and closing of the first cover 110 is detected. A detection result detected by the first cover sensor 131 is output to the controller 100 (refer to FIG. 1).

The first lock mechanism 141 is provided to the housing 2. The first lock mechanism 141 can switch the first cover 110 located at the closed position between a locked state in which the first cover is locked to the housing 2 and a non-locked state in which the first cover is not locked to the housing 2.

Figure 5A:
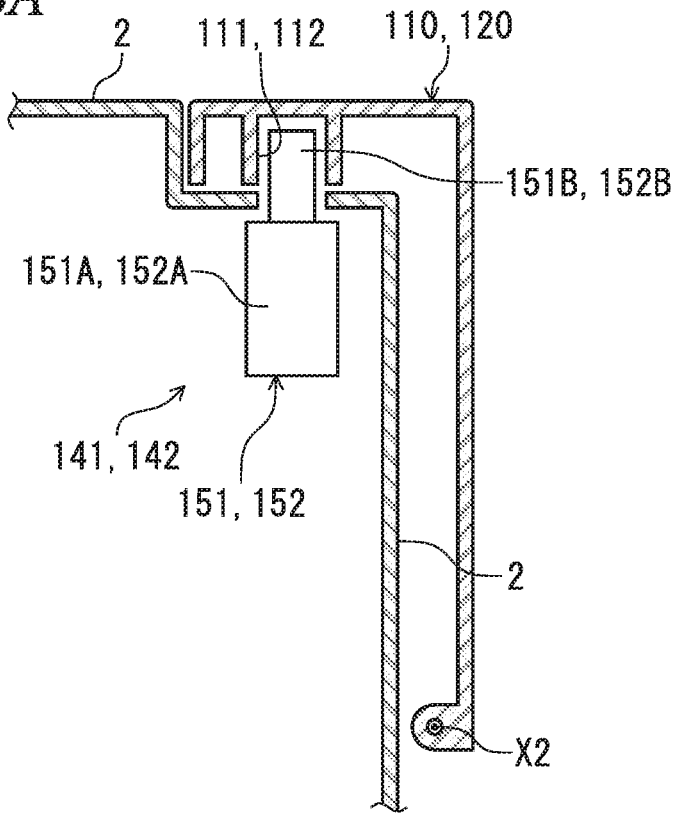
FIG. 5A illustrates a locked state of the cover.
Figure 5B:
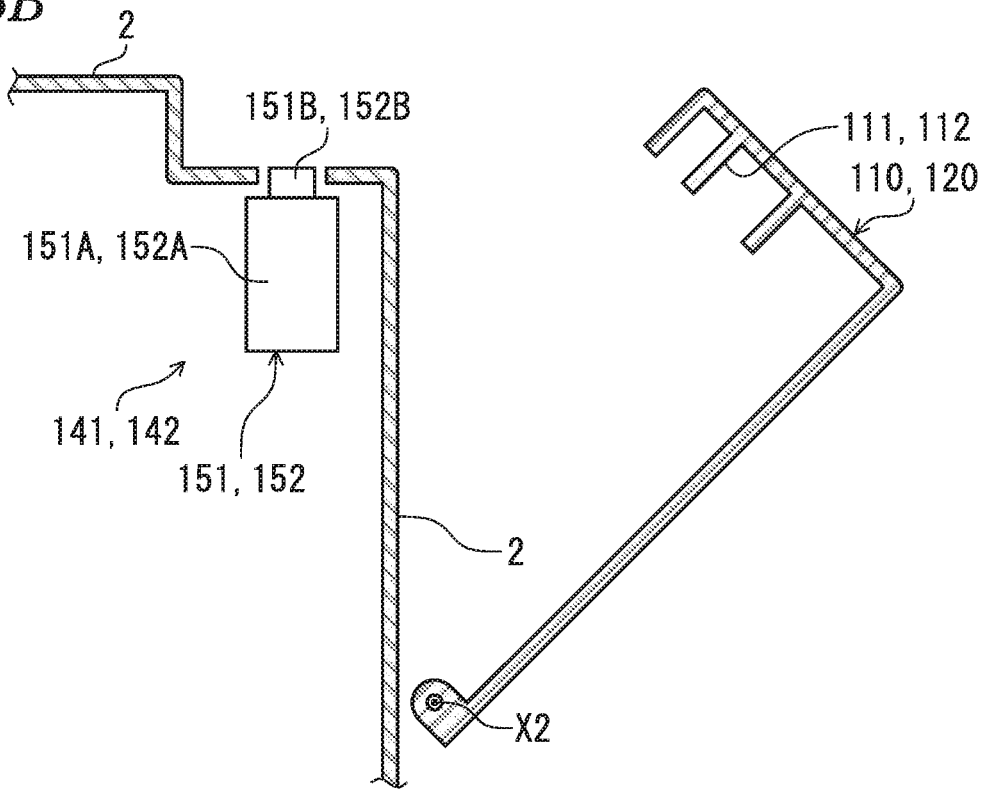
FIG. 5B illustrates a non-locked state.

As shown in FIGS. 5A and 5B, the first lock mechanism 141 includes a first solenoid 151. The first solenoid 151 has a main body part 151A and a moveable part 151B. When the first solenoid 151 becomes ON, the moveable part 151B is retreated into the main body part 151A (FIG. 5B), and when the first solenoid becomes OFF, the moveable part 151B protrudes from the main body part 151A (FIG. 5A).

When the first solenoid 151 is OFF, the moveable part 151B engages with the first concave portion 111 of the first cover 110. Thereby, the first cover 110 is locked to the housing 2 and is thus in the locked state. As shown in FIG. 5B, when the first solenoid 151 is ON, the engagement between the moveable part 151B and the first concave portion 111 is released. Thereby, the first cover 110 is in the non-locked state in which it is not locked to the housing 2. The first cover 110 in the non-locked state is slightly moved from the closed position toward the opened position by its own weight or a spring (not shown).

As shown in FIGS. 3 and 4B, the second cover 120 is smaller than the first cover 110 in the axial direction. The second cover 120 is in alignment with the first cover 110 in the axial direction. The second cover 120 can rotate about the second axis X2. That is, in the first illustrative embodiment, the second cover 120 can rotate about the same axis as the first cover 110. The second cover 120 can rotate between a closed position (a position shown in FIG. 3) at which a part of the remaining of the opening 23 is covered and an opened position (a position shown in FIG. 4B) at which a part of the remaining of the opening 23 is opened.

The second cover 120 has a second concave portion 121 and a protrusion 122. The second concave portion 121 engages with a second lock mechanism 142 (which will be described later), so that the second cover 120 is locked to the housing 2. The protrusion 122 extends from the second cover 120 located at the closed position toward an inside of the housing 2. The protrusion 122 can contact the drum cartridge 8 when the second cover 120 is located at the closed position (refer to FIG. 6A).

The image forming apparatus 1 further includes a second cover sensor 132 and a second lock mechanism 142.

The second cover sensor 132 is provided on the front surface of the housing 2 facing the second cover 120 of the housing 2. The second cover sensor 132 is configured to detect opening and closing of the second cover 120. The second cover sensor 132 is a push switch, for example. Specifically, when the second cover 120 is located at the closed position, the second cover 120 is in contact with the second cover sensor 132, and when the second cover 120 is located at the opened position, the second cover 120 is not in contact with the second cover sensor 132, so that the opening and closing of the second cover 120 is detected. A detection result detected by the second cover sensor 132 is output to the controller 100 (refer to FIG. 1).

The second lock mechanism 142 is provided at a front frame 22. The second lock mechanism 142 can switch the second cover 120 located at the closed position between a locked state in which the second cover is locked to the housing 2 and a non-locked state in which the second cover is not locked to the housing 2. In the meantime, since the second lock mechanism 142 has the similar configuration to the first lock mechanism 141, the reference numerals of the constitutional members thereof are denoted side by side in FIGS. 5A and 5B.

The second lock mechanism 142 includes a second solenoid 152. The second solenoid 152 has a main body part 152A and a moveable part 152B. When the second solenoid 152 becomes ON, the moveable part 152B is retreated into the main body part 152A (FIG. 5B), and when the second solenoid becomes OFF, the moveable part 152B protrudes from the main body part 152A (FIG. 5A).

When the second solenoid 152 is OFF, the moveable part 152B engages with the second concave portion 121 of the second cover 120. Thereby, the second cover 120 is locked to the housing 2 and is thus in the locked state. As shown in FIG. 5B, when the second solenoid 152 is ON, the engagement between the moveable part 152B and the second concave portion 121 is released. Thereby, the second cover 120 is in the non-locked state in which it is not locked to the housing 2. The second cover 120 in the non-locked state is slightly moved from the closed position toward the opened position by its own weight or a spring (not shown).

Figure 6A:
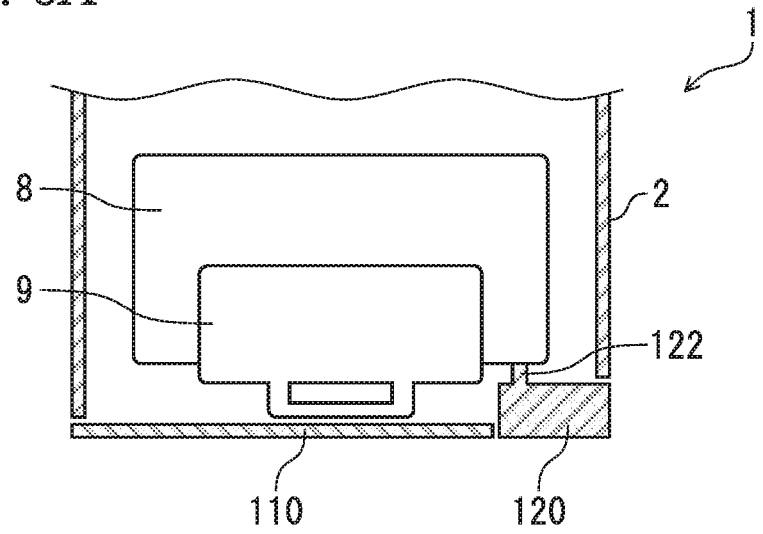
FIG. 6A is a sectional view illustrating a state where the drum cartridge is mounted to the image forming apparatus, as seen from above.

When the first cover 110 is located at the closed position, since a mounting and demounting path of the drum cartridge 8 and the toner cartridge 9 overlaps the first cover 110, the drum cartridge 8 and the toner cartridge 9 cannot be mounted and demounted to and from the housing 2. For this reason, as shown in FIG. 6A, when the first cover 110 is located at the closed position and the second cover 120 is also located at the closed position, the image forming apparatus 1 does not allow the drum cartridge 8 and the toner cartridge 9 to be mounted and demounted to and from the housing 2.

Figure 6B:
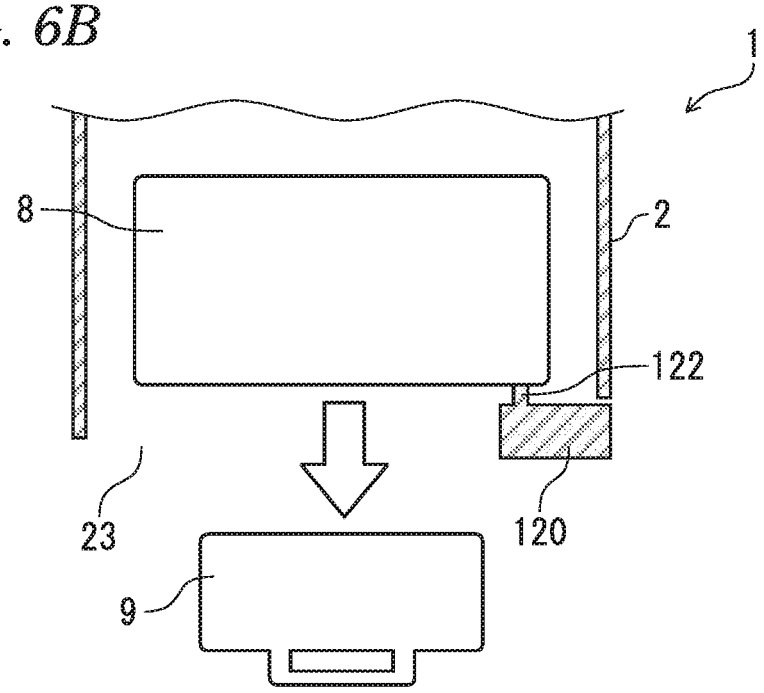
FIG. 6B illustrates a state where only the toner cartridge is removed from the state of FIG. 6A.

When the second cover 120 is located at the closed position, if a user intends to demount the drum cartridge 8 from the housing 2, the protrusion 122, which is a part of the second cover 120, is in contact with the drum cartridge 8, so that the drum cartridge 8 cannot be mounted and demounted to and from the housing 2. For this reason, as shown in FIG. 6B, when the first cover 110 is located at the opened position and the second cover 120 is located at the closed position, the image forming apparatus 1 does not allow the drum cartridge 8 to be mounted and demounted to and from the housing 2, through a part of the opening 23.

The mounting and demounting path of the toner cartridge 9 does not overlap the second cover 120 in a state in which the second cover 120 is located at the closed position. Therefore, when the first cover 110 is located at the opened position, the toner cartridge can be mounted and demounted to and from the housing 2. For this reason, when the first cover 110 is located at the opened position and the second cover 120 is located at the closed position, the image forming apparatus 1 allows the toner cartridge 9 to be mounted and demounted to and from the drum cartridge 8 through a part of the opening 23, in a state where the drum cartridge 8 is mounted to the housing 2.

Figure 7:
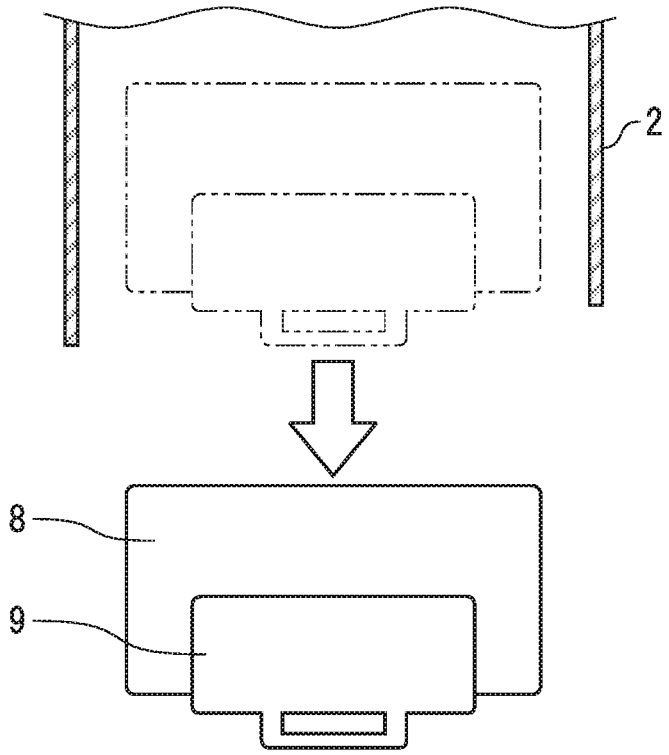
FIG. 7 illustrates a state where the drum cartridge is removed with the first cover and the second cover being opened.

As shown in FIG. 7, when the first cover 110 is located at the opened position and the second cover 120 is also located at the opened position, the image forming apparatus 1 allows the drum cartridge 8 and the toner cartridge 9 to be mounted and demounted through the opening 23.

The controller 100 includes, for example, a CPU (processor), a RAM, a ROM (memory), an input/output circuit and the like, and is configured to control the opening and closing of the first cover 110 and the second cover 120 by activating the first solenoid 151 and the second solenoid 152 based on a program and data stored in the ROM and outputs of a sheet detection sensor 160, the first cover sensor 131, the second cover sensor 132 and the like.

The controller 100 can execute first determination processing, second determination processing, third determination processing, fourth processing, fifth processing and sixth processing.

The first determination processing is processing of determining whether it is a replacement timing of the toner cartridge 9. When it is determined by the first determination processing that it is the replacement timing of the toner cartridge 9, the controller 100 executes the fourth processing of setting the first lock mechanism 141 to the non-locked state and setting the second lock mechanism 142 to the locked state.

The method of determining the replacement timing of the toner cartridge 9 is not particularly limited. For example, when light is incident in the case 90 of the toner cartridge 9, a sensor connected to the controller 100 may detect the incident light, and the controller 100 may estimate a remaining amount of the toner in the toner cartridge 9 based on the detected signal and determine the replacement time of the toner cartridge 9. Also, the controller 100 may be configured to determine the replacement timing of the toner cartridge 9 by determining whether the number of printed sheets of the mounted toner cartridge 9 reaches a predetermined number.

The second determination processing is processing of determining whether it is the replacement timing of the drum cartridge 8. When it is determined by the second determination processing that it is the replacement timing of the drum cartridge 8, the controller 100 executes the fifth processing of setting the first lock mechanism 141 to the non-locked state and setting the second lock mechanism 142 to the non-locked state.

The method of determining the replacement timing of the drum cartridge 8 is not particularly limited. For example, when it is determined that the drive time of the photosensitive drum 81 reaches predetermined time, the controller 100 may determine that it is the replacement timing of the drum cartridge 8. Also, the controller 100 may be configured to determine the replacement timing of the drum cartridge 8 by determining whether the number of printed sheets of the mounted drum cartridge 8 reaches a predetermined number.

The third determination processing is processing of determining whether it is a paper jam state. When it is determined by the third determination processing that it is the paper jam state, the controller 100 executes the sixth processing of setting the first lock mechanism 141 to the non-locked state and setting the second lock mechanism 142 to the non-locked state.

In the first illustrative embodiment, the sheet detection sensor 160 is used so as to determine whether the image forming apparatus 1 is in the paper jam state. As shown in FIG. 1, the sheet detection sensor 160 is arranged between the photosensitive drum 81 and the fixing device 7. The sheet detection sensor 160 is configured to detect passing of the recording sheet S to be conveyed. When the recording sheet S is detected for a predetermined time period or longer, the sheet detection sensor 160 determines that it is the paper jam state, and outputs a detection result to the controller 100. In the meantime, the sheet detection sensor 160 may be arranged at a plurality of places.

Subsequently, an example of the operation of the controller 100 is described in detail. The controller 100 repetitively executes a flowchart shown in FIG. 8 all the time. In a state before a power supply of the image forming apparatus 1 becomes ON, the first solenoid 151 and the second solenoid 152 are OFF. In the meantime, when the power supply of the image forming apparatus 1 becomes ON, the controller 100 executes the flowchart shown in FIG. 8.

Figure 8:
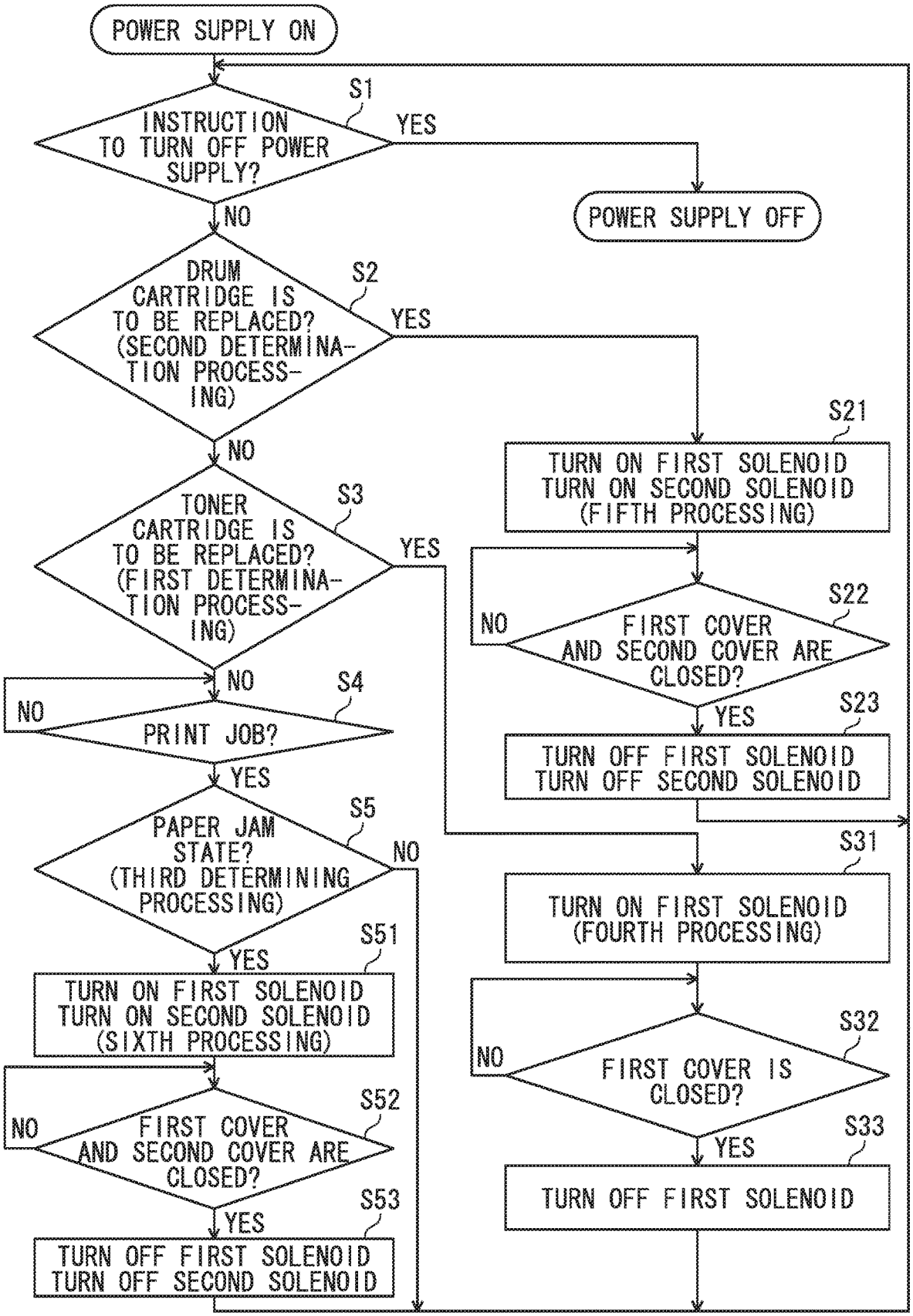
FIG. 8 is a flowchart illustrating operations of a controller.

As shown in FIG. 8, when the power supply of the image forming apparatus 1 becomes ON, the controller 100 determines whether there is an instruction to turn off the power supply (S1). In step S1, when the controller 100 determines that there is an instruction to turn off the power supply (S1, Yes), the controller 100 turns off the power supply of the image forming apparatus 1 and ends the control.

In step S1, when the controller 100 determines that there is no instruction to turn off the power supply (S1, No), the controller 100 determines whether it is the replacement timing of the drum cartridge, as the second determination processing (S2).

In step S2, when the controller 100 determines that it is the replacement timing of the drum cartridge (S2, Yes), the controller 100 executes the fifth processing to turn on the first solenoid 151 and the second solenoid 152 (S21). When the first solenoid 151 and the second solenoid 152 become ON, the first lock mechanism 141 and the second lock mechanism 142 are released. Thereby, the first cover 110 and the second cover 120 are opened, so that the user can know that it is necessary to demount and mount the drum cartridge 8. The user may close the first cover 110 and the second cover 120 after replacing the drum cartridge 8. In the meantime, when the replacement timings of the drum cartridge 8 and the toner cartridge 9 are the same, the user may replace the toner cartridge 9, together with the drum cartridge 8.

After step S21, the controller 100 determines whether the first cover 110 and the second cover 120 are closed (S22). In step S22, when the controller 100 determines that the first cover 110 and the second cover 120 are not closed (S22, No), the controller 100 waits until the first cover 110 and the second cover 120 are closed.

In step S22, when the controller 100 determines that the first cover 110 and the second cover 120 are closed (S22, Yes), the controller 100 turns off the first solenoid 151 and the second solenoid 152 (S23). Thereby, the first lock mechanism 141 and the second lock mechanism 142 are in the locked state, so that the first cover 110 and the second cover 120 are locked to the housing 2. After step S23, the controller returns to step S1.

In step S2, when the controller 100 determines that it is not the replacement timing of the drum cartridge 8 (S2, No), the controller 100 determines whether it is the replacement timing of the toner cartridge 9, as the first determination processing (S3).

In step S3, when the controller 100 determines that it is the replacement timing of the toner cartridge 9 (S3, Yes), the controller 100 executes the fourth processing to turn on the first solenoid 151 (S31). In the meantime, the second solenoid 152 stays OFF. When the first solenoid 151 becomes ON, the first lock mechanism 141 is released. Thereby, only the first cover 110 is opened. When only the first cover 110 is opened, the user can know that it is the replacement timing of the toner cartridge 9. The user may close the first cover 110 after replacing the toner cartridge 9.

After step S31, the controller 100 determines whether the first cover 110 is closed (S32). In step S32, when the controller 100 determines that the first cover 110 is not closed (S23, No), the controller 100 waits until the first cover 110 is closed.

In step S32, when the controller 100 determines that the first cover 110 is closed (S32, Yes), the controller 100 turns off the first solenoid 151 (S33). Thereby, the first lock mechanism 141 is in the locked state, so that the first cover 110 is locked to the housing 2. After step S33, the controller returns to step S1.

In step S3, when the controller 100 determines that it is not the replacement timing of the toner cartridge 9 (S3, No), the controller 100 determines whether there is a print job (S4). In step S4, when the controller 100 determines that there is no print job (S4, No), the controller 100 waits until a print job is received.

In step S4, when the controller 100 determines that there is a print job (S4, Yes), the controller 100 determines whether it is a paper jam state, as the third determination processing (S5). In step S5, when the controller 100 determines that it is not a paper jam state (S5, No), the controller returns to step S1.

In step S5 when the controller 100 determines that it is a paper jam state (S5, Yes), the controller 100 executes the sixth processing to turn on the first solenoid 151 and the second solenoid 152 (S51). When the first solenoid 151 and the second solenoid 152 become ON, the first lock mechanism 141 and the second lock mechanism 142 are released. Thereby, the first cover 110 and the second cover 120 are opened. When the first cover 110 and the second cover 120 are opened, the user can know that it is necessary to demount and mount the drum cartridge 8. The user may demount the drum cartridge 8 to resolve the paper jam, mount the drum cartridge 8 and close the first cover 110 and the second cover 120.

After step S51, the controller 100 determines whether the first cover 110 and the second cover 120 are closed (S52). In step S52, when the controller 100 determines that the first cover 110 and the second cover 120 are not closed (S52, No), the controller 100 waits until the first cover 110 and the second cover 120 are closed.

In step S52, when the controller 100 determines that the first cover 110 and the second cover 120 are closed (S52, Yes), the controller 100 turns off the first solenoid 151 and the second solenoid 152 (S53), and returns to step S1. Thereby, the first lock mechanism 141 and the second lock mechanism 142 are in the locked state, so that the first cover 110 and the second cover 120 are locked to the housing 2.

In the below, advantages of the image forming apparatus 1 configured as described above are described.

When both the first cover 110 and the second cover 120 of the image forming apparatus 1 are opened, the drum cartridge 8 can be mounted and demounted. When only the first cover 110 is opened, only the toner cartridge 9 can be mounted and demounted. For this reason, when replacing the toner cartridge 9, it is not necessary to intentionally mount and demount the drum cartridge 8. Also, when only the first cover 110 is opened, there is no concern that the user erroneously mounts and demounts the drum cartridge 8. As a result, it is possible to easily replace the toner cartridge 9 and the drum cartridge 8 from the image forming apparatus 1.

Also, since both the first cover 110 and the second cover 120 are the front covers, the user can perform an operation from the front side when opening and closing any of the first cover and the second cover.

Also, since the second lock mechanism 142 capable of switching the second cover 120 located at the closed position between the locked state in which the second cover is locked to the housing 2 and the non-locked state in which the second cover is not locked to the housing 2 is provided, it is possible to suppress the second cover 120 from being opened when mounting and demounting the toner cartridge 9.

Also, since the first lock mechanism 141 capable of switching the first cover 110 located at the closed position between the locked state in which the first cover is locked to the housing 2 and the non-locked state in which the first cover is not locked to the housing 2 is provided, it is possible to suppress the first cover 120 from being opened when not mounting and demounting the toner cartridge 9 and the drum cartridge 8.

Also, when the controller 100 determines that it is the replacement timing of the toner cartridge 9, the controller 100 sets the first cover 110 to the non-locked state and sets the second cover 120 to the locked state. For this reason, the user can mount and demount the toner cartridge 9 without mistaking the toner cartridge for the drum cartridge 8. Also, the first cover 110 in the non-locked state is slightly opened, so that it is possible to notify the user of the replacement timing of the toner cartridge 9.

Also, when the controller 100 determines that it is the replacement timing of the drum cartridge 8, the controller 100 sets the first cover 110 to the non-locked state, and sets the second cover 120 to the non-locked state. For this reason, the user can mount and demount the drum cartridge 8 without mistaking the drum cartridge for the toner cartridge 9. Also, the first cover 110 and the second cover 120 in the non-locked state are slightly opened, so that it is possible to notify the user that it is necessary to demount and mount the drum cartridge 8.

Also, when the controller 100 determines that it is the paper jam state, the controller 100 sets the first cover 110 to the non-locked state, and sets the second cover 120 to the non-locked state. Thereby, when it is in the paper jam state, the user can mount and demount the drum cartridge 8 without mistaking the drum cartridge for the toner cartridge 9. Also, the first cover 110 and the second cover 120 in the non-locked state are slightly opened, so that it is possible to notify the user that it is necessary to demount and mount the drum cartridge 8.

Although the illustrative embodiment of the present disclosure has been described, the present disclosure is not limited to the illustrative embodiment. The specific configuration can be appropriately changed without departing from the gist of the present disclosure.

In the above illustrative embodiment, the first lock mechanism configured to lock the first cover to the housing is provided. However, instead of the first lock mechanism, a third lock mechanism configured to lock the first cover to the second cover may be provided.

Figure 9B:
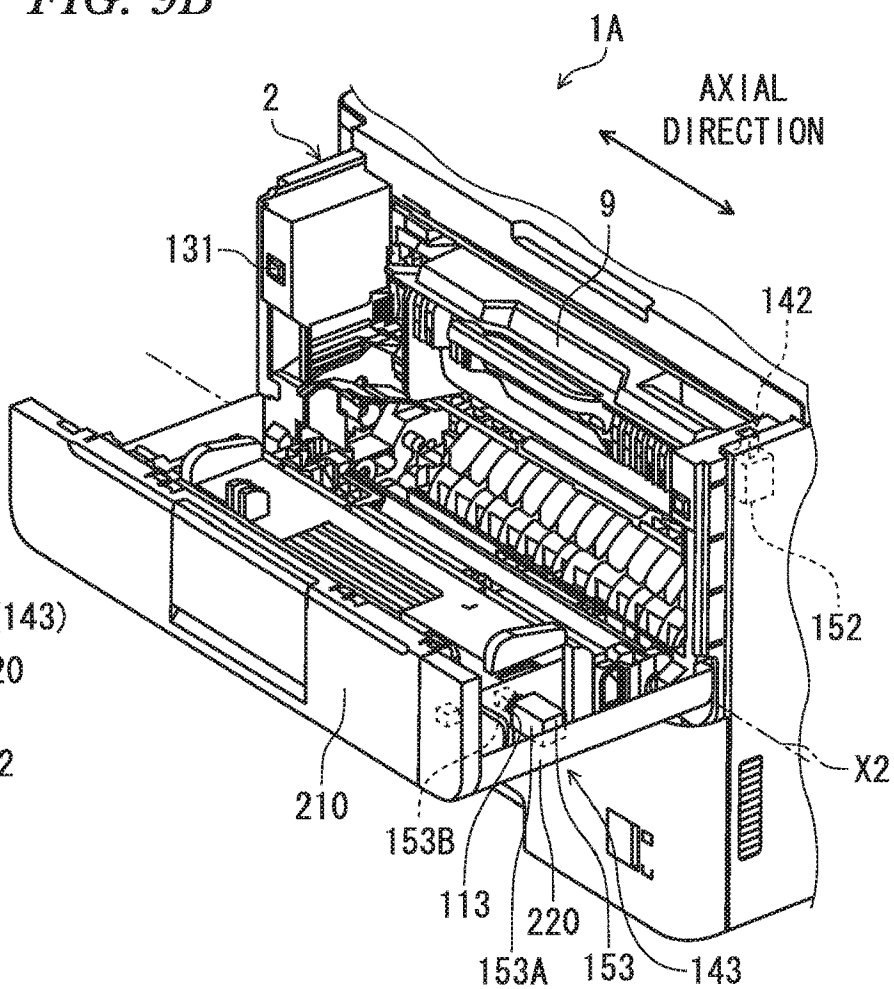
FIG. 9A and FIG. 9B are views corresponding to FIG. 4, illustrating a second illustrative embodiment.
Figure 9A:
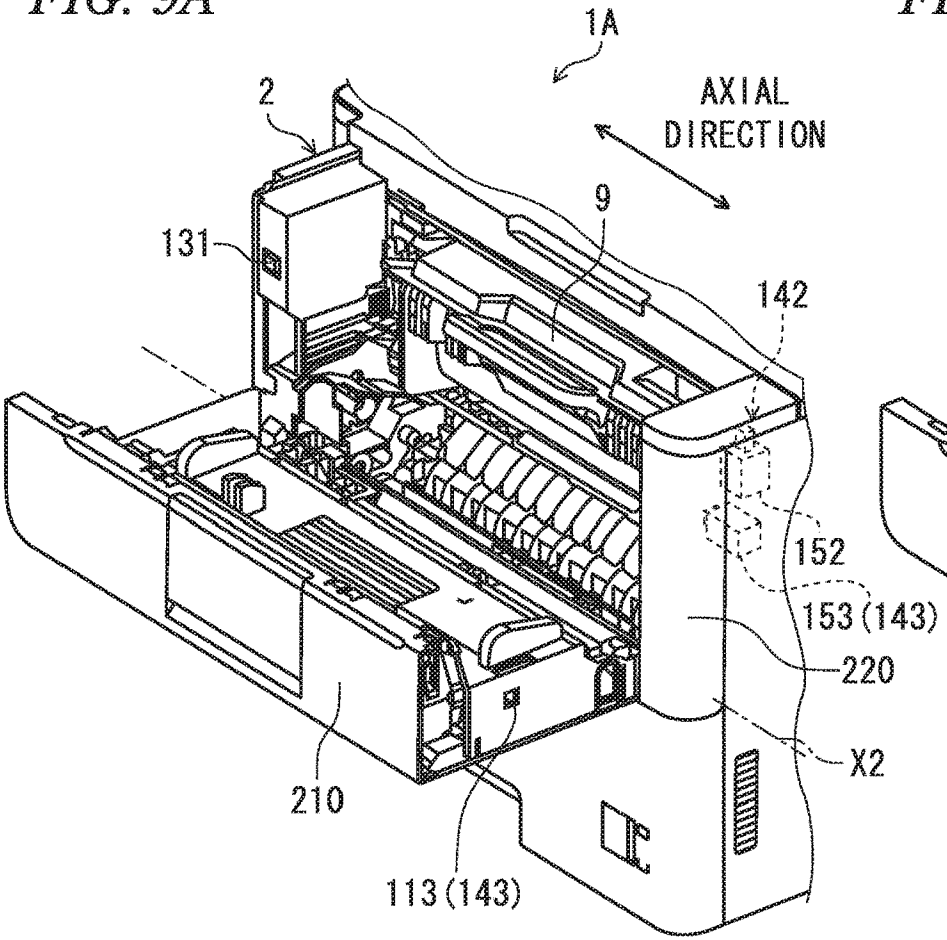
Figure 10:
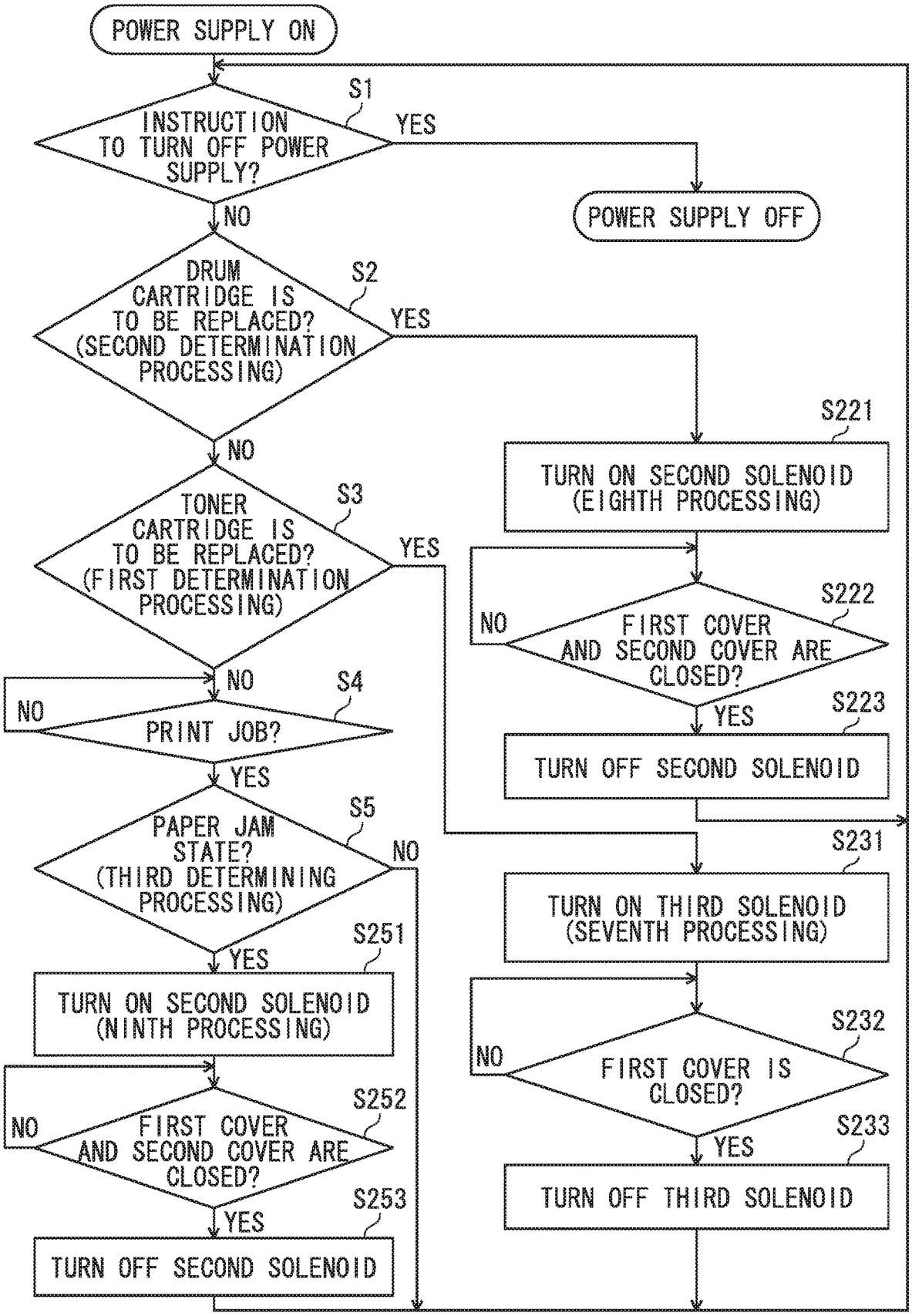
FIG. 10 is a flowchart illustrating operations of the controller in the second illustrative embodiment.
Figure 11:
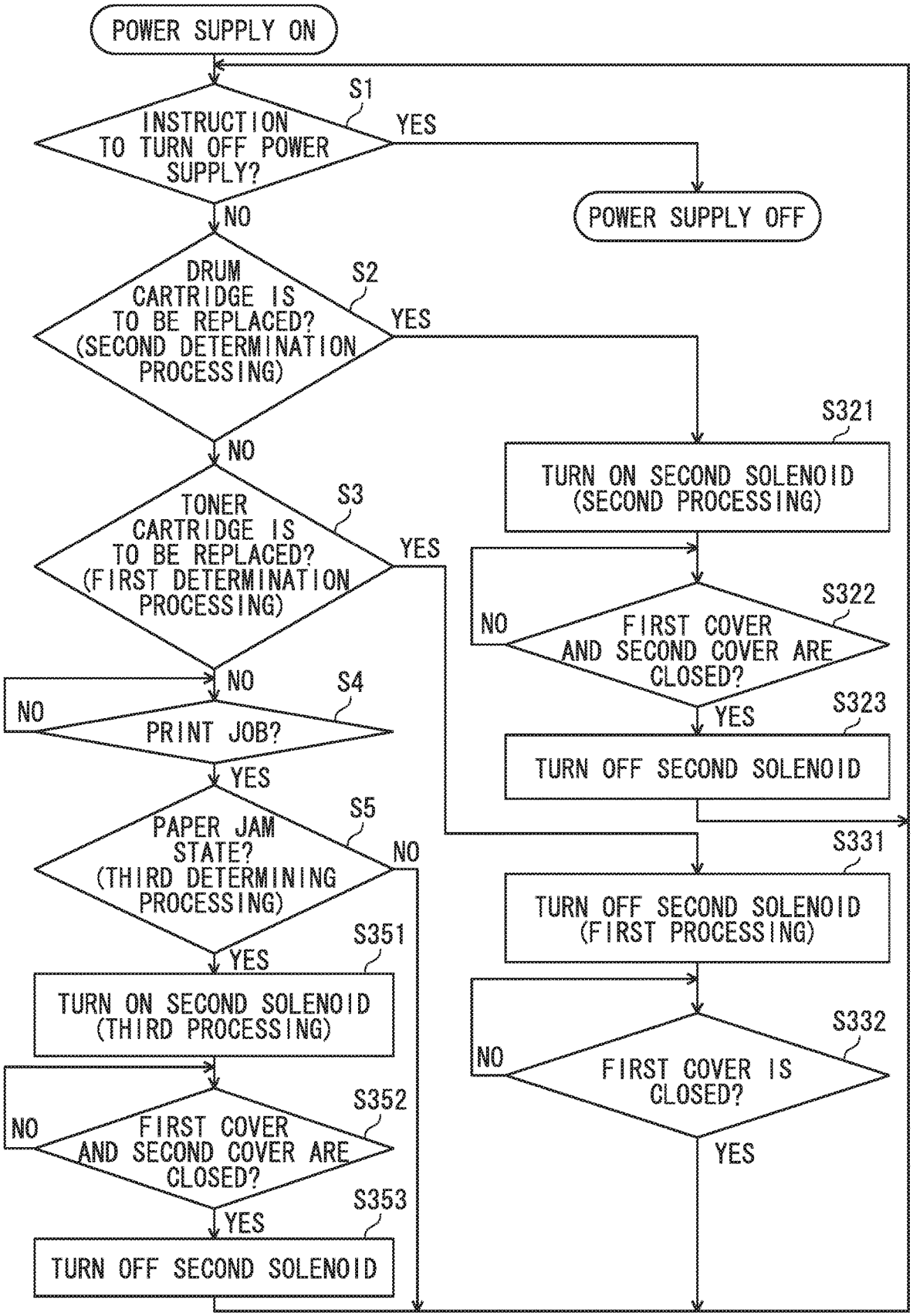
FIG. 11 is a flowchart illustrating operations of the controller in a third illustrative embodiment.

For example, an image forming apparatus 1A of a second illustrative embodiment includes a third lock mechanism 143 configured to lock a first cover 210 to a second cover 220, as shown in FIGS. 9A and 9B. The third lock mechanism 143 can switch the first cover 210 between a locked state in which the first cover is locked to the second cover 220 and a non-locked state in which the first cover is not locked to the second cover.

The third lock mechanism 143 includes a third solenoid 153 and a third concave portion 113. The third solenoid 153 has a main body part 153A and a moveable part 153B. When the third solenoid 153 becomes ON, the moveable part 153B is retreated into the main body part 153A, and when the third solenoid becomes OFF, the moveable part 153B protrudes from the main body part 153A.

When the third solenoid 153 is OFF, the moveable part 153B engages with the third concave portion 113. Thereby, the first cover 210 is locked to the second cover 220 and is thus in the locked state. As shown in FIG. 9B, when the third solenoid 153 is ON, the engagement between the moveable part 153B and the third concave portion 113 is released. Thereby, the first cover 210 is in the non-locked state in which it is not locked to the second cover 220. In the second illustrative embodiment, when the third lock mechanism 143 is in the non-locked state, the first cover 210 is slightly moved from the closed position toward the opened position by its own weight or a spring (not shown).

In the second illustrative embodiment, the controller 100 can execute seventh processing, eighth processing and ninth processing, instead of the fourth processing, the fifth processing and the sixth processing of the first illustrative embodiment.

When it is determined by the first determination processing that it is the replacement timing of the toner cartridge 9, the controller 100 executes the seventh processing of setting the second lock mechanism 142 to the locked state and setting the third lock mechanism 143 to the non-locked state.

When it is determined by the second determination processing that it is the replacement timing of the drum cartridge 8, the controller 100 executes the eighth processing of setting the second lock mechanism 142 to the non-locked state and setting the third lock mechanism 143 to the locked state.

When it is determined by the third determination processing that it is the paper jam state, the controller 100 executes the ninth processing of setting the second lock mechanism 142 to the non-locked state and setting the third lock mechanism 143 to the locked state.

Subsequently, an example of the operation of the controller 100 of the second illustrative embodiment is described in detail. Since the processing of step S1 to step S5 is similar to the first illustrative embodiment, some descriptions are omitted. In the state before the power supply of the image forming apparatus 1 becomes ON, the second solenoid 152 and the third solenoid 153 are OFF.

In step S2, when the controller 100 determines that it is the replacement timing of the drum cartridge (S2, Yes), the controller 100 executes the eighth processing to turn on the second solenoid 152 (S221). In the meantime, the third solenoid 153 stays OFF. When the second solenoid 152 becomes ON, the second lock mechanism 142 is released. At this time, since the third lock mechanism 143 stays OFF, the first cover 210 is opened together with the second cover 220, with being locked to the second cover 220. When the first cover 210 and the second cover 220 are opened, the user can know that it is necessary to demount and mount the drum cartridge 8. After replacing the drum cartridge 8, the user may close the first cover 210 and the second cover 220. In the meantime, when the replacement timings of the drum cartridge 8 and the toner cartridge 9 are the same, the user may replace the toner cartridge 9, together with the drum cartridge 8.

After step S221, the controller 100 determines whether the first cover 210 and the second cover 220 are closed (S222). In step S222, when the controller 100 determines that the first cover 210 and the second cover 220 are not closed (S222, No), the controller 100 waits until the first cover 210 and the second cover 220 are closed.

In step S222, when the controller 100 determines that the first cover 210 and the second cover 220 are closed (S222, Yes), the controller 100 turns off the second solenoid 152 (S223). Thereby, the second lock mechanism 142 and the third lock mechanism 143 are in the locked state, so that the first cover 210 and the second cover 220 are locked to the housing 2. After step S223, the controller returns to step S1.

In step S3, when the controller 100 determines that it is the replacement timing of the toner cartridge 9 (S3, Yes), the controller 100 executes the seventh processing to turn on the third solenoid 153 (S231). In the meantime, the second solenoid 152 stays OFF. When the third solenoid 153 becomes ON, the third lock mechanism 143 is released. Thereby, only the first cover 210 is opened. When only the first cover 210 is opened, the user can know that it is the replacement timing of the toner cartridge 9. The user may close the first cover 210 after replacing the toner cartridge 9.

After step S231, the controller 100 determines whether the first cover 210 is closed (S232). In step S232, when the controller 100 determines that the first cover 210 is not closed (S232, No), the controller 100 waits until the first cover 210 is closed.

In step S232, when the controller 100 determines that the first cover 210 is closed (S232, Yes), the controller 100 turns off the third solenoid 153 (S233). Thereby, the third lock mechanism 143 is in the locked state, so that the first cover 210 is locked to the second cover 220. After step S233, the controller returns to step S1.

In step S5, when the controller 100 determines that it is a paper jam state (S5, Yes), the controller 100 executes the ninth processing to turn on the second solenoid 152 (S251). In the meantime, the third solenoid 153 stays OFF. When the second solenoid 152 becomes ON, the second lock mechanism 142 is released. Thereby, both the first cover 210 and the second cover 220 are opened. When the first cover 210 and the second cover 220 are opened, the user can know that it is necessary to demount and mount the drum cartridge 8. The user may demount the drum cartridge 8 to resolve the paper jam, mount the drum cartridge 8 and close the first cover 210 and the second cover 220.

After step S251, the controller 100 determines whether the first cover 210 and the second cover 220 are closed (S252). In step S252, when the controller 100 determines that the first cover 210 and the second cover 220 are not closed (S252, No), the controller 100 waits until the first cover 210 and the second cover 220 are closed.

In step S252, when the controller 100 determines that the first cover 210 and the second cover 220 are closed (S252, Yes), the controller 100 turns off the second solenoid 152 (S253). Thereby, the second lock mechanism 142 is in the locked state, so that the first cover 210 and the second cover 220 are locked to the housing 2. After step S253, the controller returns to step S1.

Also in the second illustrative embodiment configured as described above, it is possible to easily replace the toner cartridge 9 and the drum cartridge 8 from the image forming apparatus 1A, like the first illustrative embodiment.

In the first illustrative embodiment, the image forming apparatus includes the first lock mechanism and the second lock mechanism. However, the first lock mechanism may be omitted. In this case, it is possible to slightly change the control of the controller 100. For example, in a third illustrative embodiment, the controller 100 can execute first processing, second processing and third processing, instead of the fourth processing, the fifth processing and the sixth processing of the first illustrative embodiment.

The first processing is processing of, in response to be determined by the first determination processing that it is the replacement timing of the toner cartridge, setting the second lock mechanism to the locked state.

The second processing is processing of, in response to be determined by the second determination processing that it is the replacement timing of the drum cartridge, setting the second lock mechanism to the non-locked state.

The third processing is processing of, in response to be determined by the third determination processing that it is the paper jam state, setting the second lock mechanism to the non-locked state.

Subsequently, an example of the operation of the controller 100 of the third illustrative embodiment is described in detail. Since the processing of step S1 to step S5 is similar to the first illustrative embodiment, some descriptions are omitted. In the state before the power supply of the image forming apparatus 1 becomes ON, the second solenoid 152 is OFF.

In step S2, when the controller 100 determines that it is the replacement timing of the drum cartridge 8 (S2, Yes), the controller 100 executes the second processing to turn on the second solenoid 152 (S321). When the second solenoid 152 becomes ON, the second lock mechanism 142 is released. Thereby, the user can open the first cover 110 and the second cover 120. After replacing the drum cartridge, the user may close the first cover 110 and the second cover 120.

After step S321, the controller 100 determines whether the first cover 110 and the second cover 120 are closed (S322). In step S322, when the controller 100 determines that the first cover 110 and the second cover 120 are not closed (S322, No), the controller 100 waits until the first cover 110 and the second cover 120 are closed.

In step S322, when the controller 100 determines that the first cover 110 and the second cover 120 are closed (S322, Yes), the controller 100 turns off the second solenoid 152 (S323). Thereby, the second lock mechanism 142 is in the locked state, so that the second cover 220 is locked to the housing 2. After step S323, the controller returns to step S1.

In step S3, when the controller 100 determines that it is the replacement timing of the toner cartridge 9 (S3, Yes), the controller 100 executes the first processing to keep the second solenoid 152 in the OFF state (S331). When second solenoid 152 stays OFF, the second lock mechanism 142 is kept in the locked state. Thereby, the user cannot open the second cover 120, and can open only the first cover 110. The user may close the first cover 110 after replacing the toner cartridge 9.

After step S331, the controller 100 determines whether the first cover 110 is closed (S332). In step S332, when the controller 100 determines that the first cover 110 is not closed (S332, No), the controller 100 waits until the first cover 110 is closed.

In step S332, when the controller 100 determines that the first cover 110 is closed (S332, Yes), the controller 100 returns to step S1.

In step S5, when the controller 100 determines that it is a paper jam state (S5, Yes), the controller 100 executes the third processing to turn on the second solenoid 152 (S351). When the second solenoid 152 becomes ON, the second lock mechanism 142 is released. The user may demount the drum cartridge 8 to resolve the paper jam, mount the drum cartridge 8 and close the first cover 110 and the second cover 120.

After step S351, the controller 100 determines whether the first cover 110 and the second cover 120 are closed (S352). In step S352, when the controller 100 determines that the first cover 110 and the second cover 120 are not closed (S352, No), the controller 100 waits until the first cover 110 and the second cover 120 are closed.

In step S352, when the controller 100 determines that the first cover 110 and the second cover 120 are closed (S352, Yes), the controller 100 turns off the second solenoid 152 (S353). Thereby, the second lock mechanism 142 is in the locked state, so that the second cover 220 is locked to the housing 2. After step S353, the controller returns to step S1.

Also in the third illustrative embodiment configured as described above, it is possible to easily replace the toner cartridge 9 and the drum cartridge 8 from the image forming apparatus, like the first illustrative embodiment.

In the respective illustrative embodiments, the first cover and the second cover in the non-locked state slightly moves from the opened position toward the closed position by the own weights or the spring. However, the first cover and the second cover may also be configured not to move in the non-locked state.

In the respective illustrative embodiments, the image forming apparatus of the monochrome laser printer has been exemplified. However, the image forming apparatus may be a color image forming apparatus, may be configured to perform the exposure by an LED, and may be a copier or a complex machine.

The respective elements of the illustrative embodiments and modified embodiments can be implemented with being arbitrarily combined.

In the description related to the illustrative embodiments, the phrase "processing of determining whether it is a replacement timing of the toner cartridge" may refer to the controller 100 determining that the toner cartridge is to be replaced. The phrase "processing of determining whether it is a replacement timing of the drum cartridge" may refer to the controller 100 determining that the controller 100 determining that the drum cartridge is to be replaced. The phrase "processing of determining whether it is a paper jam state" may refer to the controller 100 determining that the image forming apparatus 1 is in the paper jam state.

As described with reference to the illustrative embodiments, according to the present disclosure, there is provided an image forming apparatus including: a housing having an opening; a drum cartridge mountable and demountable through the opening, the drum cartridge having a photosensitive drum rotatable about a first axis extending in an axial direction; a toner cartridge mountable and demountable to and from the drum cartridge, the toner cartridge being capable of accommodating toner therein; a first cover rotatable about a second axis extending in the axial direction and rotatable between a closed position at which a part of the opening is covered and an opened position at which a part of the opening is opened; and a second cover in alignment with the first cover in the axis direction, the second cover rotatable about the second axis and being rotatable between a closed position at which a part of the remaining of the opening is covered and an opened position at which a part of the remaining of the opening is opened. In a state in which the first cover is located at the opened position and the second cover is located at the opened position, the drum cartridge and the toner cartridge are allowed to be mounted and demounted through the opening In a state in which the first cover is located at the opened position and the second cover is located at the closed position, the toner cartridge is allowed to be mounted and demounted to and from the drum cartridge through a part of the opening while the drum cartridge is remained to be mounted to the housing. In a state in which the first cover is located at the opened position and the second cover is located at the closed position, a part of the second cover contacts with the drum cartridge and prevents the drum cartridge to be mounted and demounted to and from the housing through a part of the opening.

According to the above configuration, when both the first cover and the second cover are opened, the drum cartridge can be mounted and demounted. When only the first cover is opened, only the toner cartridge can be mounted and demounted to and from the drum cartridge. For this reason, when replacing the toner cartridge, it is not necessary to intentionally mount and demount the drum cartridge. Also, when only the first cover is opened, a part of the second cover is contacted to the drum cartridge, so that the drum cartridge is not allowed to be mounted and demounted to and from the housing. Therefore, there is no concern that the user erroneously mounts and demounts the drum cartridge. As a result, it is possible to easily replace the toner cartridge and the drum cartridge from the image forming apparatus.

The first cover and the second cover are front covers of the image forming apparatus.

According to the above configuration, the user can perform an operation from the front side when opening and closing any of the first cover and the second cover.

The image forming apparatus may further include: a second lock mechanism that switches the second cover located at the closed position between a locked state in which the second cover is locked to the housing and a non-locked state in which the second cover is not locked to the housing.

According to the above configuration, when mounting and demounting the toner cartridge, it is possible to suppress the second cover from being opened.

The image forming apparatus may further include: a first lock mechanism that switches the first cover located at the closed position between a locked state in which the first cover is locked to the housing and a non-locked state in which the first cover is not locked to the housing.

According to the above configuration, it is possible to suppress the first cover from being opened when not mounting and demounting the toner cartridge and the drum cartridge.

The image forming apparatus may further include: a third lock mechanism that switches the first cover between a locked state in which the first cover is locked to the second cover and a non-locked state in which the first cover is not locked to the second cover.

According to the above configuration, it is possible to suppress the first cover from being opened when not mounting and demounting the toner cartridge and the drum cartridge.

The image forming apparatus may further include: a controller that is configured to: determine that the toner cartridge is to be replaced; and set the second lock mechanism to the locked state based on determining that the toner cartridge is to be replaced.

According to the above configuration, when it is determined that it is the replacement timing of the toner cartridge, it is possible to set the second cover to the locked state. Thereby, when replacing the toner cartridge, it is possible to mount and demount only the toner cartridge by opening only the first cover.

The controller may be configured to: determine that the drum cartridge is to be replaced; and set the second lock mechanism to the non-locked state based on determining that the drum cartridge is to be replaced.

According to the above configuration, when it is determined that it is the replacement timing of the drum cartridge, it is possible to set the second cover to the non-locked state. Thereby, when replacing the drum cartridge, it is possible to mount and demount the drum cartridge.

The controller may be configured to: determine that the image forming apparatus is in a paper jam state; and set the second lock mechanism to the non-locked state based on determining that the image forming apparatus is in the paper jam state.

According to the above configuration, when it is determined that it is the paper jam state, it is possible to set the second cover to the non-locked state. Thereby, it is possible to mount and demount the drum cartridge when it is the paper jam state.

The image forming apparatus may further include: a controller that is configured to: determine that the toner cartridge is to be replaced; and set the first lock mechanism to the non-locked state and set the second lock mechanism to the locked state based on determining that the toner cartridge is to be replaced.

According to the above configuration, when it is determined that it is the replacement timing of the toner cartridge, it is possible to set the first cover to the non-locked state and to set the second cover to the locked state. For this reason, the user can mount and demount only the toner cartridge without mistaking the toner cartridge for the drum cartridge.

The controller may be configured to: determine that the drum cartridge is to be replaced; and set the first lock mechanism to the non-locked state and set the second lock mechanism to the non-locked state based on determining that the drum cartridge is to be replaced.

According to the above configuration, when it is determined that it is the replacement timing of the drum cartridge, it is possible to set the first cover to the non-locked state and to set the second cover to the non-locked state. For this reason, the user can mount and demount the drum cartridge without mistaking the drum cartridge for the toner cartridge.

The controller may be configured to: determine that the image forming apparatus is in a paper jam state; and set the first lock mechanism to the non-locked state and set the second lock mechanism to the non-locked state based on determining that the image forming apparatus is in the paper jam state.

According to the above configuration, when it is determined that it is the paper jam state, it is possible to set the first cover to the non-locked state and to set the second cover to the non-locked state. For this reason, the user can mount and demount the drum cartridge without mistaking the drum cartridge for the toner cartridge.

The image forming apparatus may further include: a controller that is configured to: determine that the toner cartridge is to be replaced; and set the second lock mechanism to the locked state and set the third lock mechanism to the non-locked state based on determining that the toner cartridge is to be replaced.

According to the above configuration, when it is determined that it is the replacement timing of the toner cartridge, it is possible to set the second cover to the locked state. Thereby, when replacing the toner cartridge, it is possible to mount and demount only the toner cartridge by opening only the first cover.

The controller may be configured to: determine that the drum cartridge is to be replaced; and set the second lock mechanism to the non-locked state and setting the third lock mechanism to the locked state based on determining that drum cartridge is to be replaced.

According to the above configuration, when it is determined that it is the replacement timing of the drum cartridge, it is possible to set the first cover to the non-locked state and to set the second cover to the locked state with respect to the first cover. For this reason, when the user operates any one of the first cover and the second cover, the user can open both the covers. Therefore, it is possible to mount and demount the drum cartridge without mistaking the drum cartridge for the toner cartridge.

The controller may be configured to: determine that the image forming apparatus is in a paper jam state; and set the second lock mechanism to the non-locked state and set the first lock mechanism to the locked state based on determined that the image forming apparatus is in the paper jam state.

According to the above configuration, when it is determined that it is the paper jam state, it is possible to set the first cover to the non-locked state and to set the second cover to the locked state with respect to the first cover. For this reason, when the user operates any one of first cover and the second cover, the user can open both the covers. Therefore, it is possible to mount and demount the drum cartridge without mistaking the drum cartridge for the toner cartridge.

According to the present disclosure, it is possible to easily replace the toner cartridge and the drum cartridge from the image forming apparatus.

What is claimed is:

1. An image forming apparatus comprising:

a housing having an opening;

a drum cartridge mountable and demountable through the opening, the drum cartridge having a photosensitive drum rotatable about a first axis extending in an axial direction;

a toner cartridge mountable and demountable to and from the drum cartridge, the toner cartridge being capable of accommodating toner therein;

a first cover rotatable about a second axis extending in the axial direction and rotatable between a closed position at which a part of the opening is covered and an opened position at which a part of the opening is opened; and a second cover in alignment with the first cover in the axis direction, the second cover rotatable about the second axis and being rotatable between a closed position at which a part of the remaining of the opening is covered and an opened position at which a part of the remaining of the opening is opened, wherein, in a state in which the first cover is located at the opened position and the second cover is located at the opened position, the drum cartridge and the toner cartridge are allowed to be mounted and demounted through the opening, wherein, in a state in which the first cover is located at the opened position and the second cover is located at the closed position, the toner cartridge is allowed to be mounted and demounted to and from the drum cartridge through a part of the opening while the drum cartridge is remained to be mounted to the housing, and wherein, in a state in which the first cover is located at the opened position and the second cover is located at the closed position, a part of the second cover contacts with the drum cartridge and prevents the drum cartridge to be mounted and demounted to and from the housing through a part of the opening.

2. The image forming apparatus according to claim 1, wherein the first cover and the second cover are front covers of the image forming apparatus.

3. The image forming apparatus according to claim 1 further comprising:

a second lock mechanism that switches the second cover located at the closed position between a locked state in which the second cover is locked to the housing and a non-locked state in which the second cover is not locked to the housing.

4. The image forming apparatus according to claim 3 further comprising:

a first lock mechanism that switches the first cover located at the closed position between a locked state in which the first cover is locked to the housing and a non-locked state in which the first cover is not locked to the housing.

5. The image forming apparatus according to claim 4 further comprising:

a controller that is configured to:

determine that the toner cartridge is to be replaced; and set the first lock mechanism to the non-locked state and set the second lock mechanism to the locked state based on determining that the toner cartridge is to be replaced.

6. The image forming apparatus according to claim 5, wherein the controller is configured to:

determine that the drum cartridge is to be replaced; and set the first lock mechanism to the non-locked state and set the second lock mechanism to the non-locked state based on determining that the drum cartridge is to be replaced.

7. The image forming apparatus according to claim 5, wherein the controller is configured to:

determine that the image forming apparatus is in a paper jam state; and set the first lock mechanism to the non-locked state and set the second lock mechanism to the non-locked state based on determining that the image forming apparatus is in the paper jam state.

8. The image forming apparatus according to claim 3 further comprising:

a third lock mechanism that switches the first cover between a locked state in which the first cover is locked to the second cover and a non-locked state in which the first cover is not locked to the second cover.

9. The image forming apparatus according to claim 8 further comprising:

a controller that is configured to:

determine that the toner cartridge is to be replaced; and set the second lock mechanism to the locked state and set the third lock mechanism to the non-locked state based on determining that the toner cartridge is to be replaced.

10. The image forming apparatus according to claim 9, wherein the controller is configured to:

determine that the drum cartridge is to be replaced; and set the second lock mechanism to the non-locked state and setting the third lock mechanism to the locked state based on determining that drum cartridge is to be replaced.

11. The image forming apparatus according to claim 9, wherein the controller is configured to:

determine that the image forming apparatus is in a paper jam state; and set the second lock mechanism to the non-locked state and set the first lock mechanism to the locked state based on determined that the image forming apparatus is in the paper jam state.

12. The image forming apparatus according to claim 3 further comprising:

a controller that is configured to:

determine that the toner cartridge is to be replaced; and set the second lock mechanism to the locked state based on determining that the toner cartridge is to be replaced.

13. The image forming apparatus according to claim 12, wherein the controller is configured to:

determine that the drum cartridge is to be replaced; and set the second lock mechanism to the non-locked state based on determining that the drum cartridge is to be replaced.

14. The image forming apparatus according to claim 12, wherein the controller is configured to:

determine that the image forming apparatus is in a paper jam state; and set the second lock mechanism to the non-locked state based on determining that the image forming apparatus is in the paper jam state.

* * * * *